US005352041A

United States Patent [19]

Fullerton et al.

[11] Patent Number: 5,352,041

[45] Date of Patent: Oct. 4, 1994

[54] SECURITY BAG FOR VALUABLE ARTICLES

[75] Inventors: Murray G. Fullerton; Michael R. Clacy, both of Redmond, Wash.

[73] Assignee: Trigon Packaging Corporation, Redmond, Wash.

[21] Appl. No.: 11,477

[22] Filed: Jan. 26, 1993

[51] Int. Cl.[5] ..... B65D 30/122; B65D 33/16; B65D 33/34

[52] U.S. Cl. ..... 383/5; 383/38

[58] Field of Search ..... 383/5, 38, 40

[56] References Cited

U.S. PATENT DOCUMENTS

| | | | |
|---|---|---|---|
| 1,688,699 | 10/1926 | Gardner | 383/40 |
| 3,315,878 | 4/1967 | Hiersteiner | 229/72 |
| 3,420,432 | 1/1969 | Cooper | 229/71 |
| 3,762,628 | 10/1973 | Sargent | 229/56 |
| 3,827,625 | 8/1974 | Miller | 383/93 |
| 4,129,214 | 12/1978 | Gendron | 206/629 |
| 4,256,256 | 3/1981 | Meyers | 229/56 |
| 4,483,018 | 11/1984 | Whelan | 383/5 |
| 4,653,113 | 3/1987 | Taylor | 383/5 |
| 4,720,040 | 1/1988 | Gurewitz | 232/1 |
| 4,733,817 | 3/1988 | Makowka | 229/69 |
| 4,988,547 | 1/1991 | Voto, Jr. et al. | 383/5 |
| 4,993,844 | 2/1991 | Robinson et al. | 383/38 |
| 5,077,001 | 12/1991 | Makowka | 383/5 |
| 5,108,194 | 4/1992 | Raden | 383/5 |
| 5,205,649 | 4/1993 | Fullerton | 383/5 |

FOREIGN PATENT DOCUMENTS

| | | | |
|---|---|---|---|
| 2066209 | 7/1981 | United Kingdom | 383/40 |
| 2081215 | 2/1982 | United Kingdom | 383/38 |

*Primary Examiner*—Stephen P. Garbe
*Attorney, Agent, or Firm*—Christensen, O'Connor, Johnson & Kindness

[57] ABSTRACT

A security bag for storing and transporting valuable articles includes an upper pouch and a lower pouch that are not overlapping that prevents unauthorized parties from entering one pouch and hiding such entry with articles in the other pouch. The upper pouch and the lower pouch open at upper ends of the respective pouches. The security bags are useful for storing and transporting currency and negotiable instruments or receipts.

19 Claims, 6 Drawing Sheets

SECURITY BAG FOR VALUABLE ARTICLES

FIELD OF THE INVENTION

The present invention relates to security bags for storing and transporting valuable articles, such as currency and negotiable instruments.

BACKGROUND OF THE INVENTION

There is an existing need for packaging for storing and transporting valuable articles, for instance, currency and negotiable instruments. For example, with respect to currency and negotiable instruments, the risk of theft or shortages when such articles are transported from depositors to banks or vice versa is an ongoing problem. Many companies presently use cash security bags that are canvas with locking means that can easily be entered without detection.

Some present-day cash and security bags made from plastic, such as the one described in Reissue Patent No. 33,173, include a full-length pouch for receiving currency and a window pouch for negotiable instruments or deposit slips superimposed over a portion of the currency pouch. The drawback of these types of bags is that access to the currency pouch can be gained by entering the window pouch and cutting a small slit in the underlying currency pouch. Generally, entry into the window pouch can be accomplished rather easily and in an undetectable manner because the seal is resealable and thus not tamper evident. Currency can then be removed through the slit. This unauthorized entry and removal of currency can go undetected because the slit in the currency pouch can be covered by the checks or deposit slips in the window pouch.

Another security bag is described in U.S. Pat. No. 4,720,040 to Gurewitz. The security bag described in Gurewitz includes an upper pouch that opens in one direction and a lower pouch that opens in the opposite direction. According to Gurewitz, both pouches are provided with closure flaps that include pressure-sensitive adhesive that is generally regarded as permanent so that any unauthorized attempts to open the pouch will be evidenced visually by tearing or distortion of the closure or the pouch wall to which the closure is sealed. When the bag of Gurewitz is filled with currency in one pouch and negotiable instruments in another pouch, it is inevitable that one of the closure flaps will be under a load created by the articles within the inverted pouch due to the force of gravity. Unless a secure seal is provided for both closures, it is possible that the particular pouch may inadvertently open and lose its contents. While the permanent seal on both pouches helps to address the problem described above, users of security bags often desire to have a resealable closure on the pouch that is to receive negotiable instruments so that inadvertently omitted instruments or receipts can be placed in the pouch after it has been previously sealed. Furthermore, with security bags that include pouches opening in different directions and closure flaps with differing orientations, it is normally necessary to p tint instructions in two different orientations for the convenience of the user.

Security bags similar to those described in the Gurewitz patent are manufactured by processes that include relatively complex steps of folding a single sheet of plastic in order to provide pouches opening in opposite directions. Generally, it is desirable to avoid complex steps in manufacturing processes in order to reduce the risk of downtime for servicing and troubleshooting.

With the large volumes of cash and negotiable instruments that are exchanged between depositors and banks, there is an ongoing need to reduce the risk of theft and shortages. Since there is always a question as to who is to blame for such thefts or shortages, both the depositors and the banks have a vested interest in reducing such activities. Accordingly, there is a desire for a security bag that is secure, user-friendly, and manufactured by a reliable and cost-effective process.

SUMMARY OF THE INVENTION

The present invention is a security bag for storing and transporting valuable articles. The security bag includes at least two pouches for separating different types of valuable articles, such as currency and negotiable instruments. The pouches of the security bags formed in accordance with the present invention do not overlap and therefore any unauthorized entry into one pouch cannot be camouflaged or hidden by articles in the other pouch.

A security bag formed in accordance with the present invention for storing and transporting valuable articles includes a first sheet of plastic having a first length and a first width, opposed marginal first and second edges, and opposed first and second ends extending between the first and second edges. A second sheet of plastic having a width substantially equal to the first width and a length less than the first length is connected along a lower end to the second end and connected along its marginal edges to the marginal first and second edges of the first sheet. A lower pouch open at an upper end is thus formed between the first sheet and the second sheet. The security bag also includes a third sheet of plastic having a width substantially equal to the first width and a length less than the difference between the length of the second sheet and the first length of the first sheet. The third sheet is connected along a lower end to the first sheet above the lower pouch and connected along its marginal edges to the first and second marginal edges of the first sheet. An upper pouch open at an upper end is thus formed between the first sheet and the third sheet. In accordance with the present invention, the upper pouch and the lower pouch are not overlapping. Accordingly, any slit cut through the first sheet, second sheet, or third sheet to gain unauthorized entry into either pouch cannot be hidden by placing articles such as negotiable instruments or receipts over the slit.

A modification of the bag described in the previous paragraph includes a fourth sheet of plastic connected to the first sheet on a side opposite the upper and lower pouch to provide a rear pouch between the first and fourth sheets of plastic.

The security bag formed in accordance with the present invention is secure and reduces the risk of unauthorized parties entering one of the pouches and hiding the entry with documents or articles contained in another pouch. The bag can be manufactured without complicated folding steps that can increase the cost of manufacturing.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
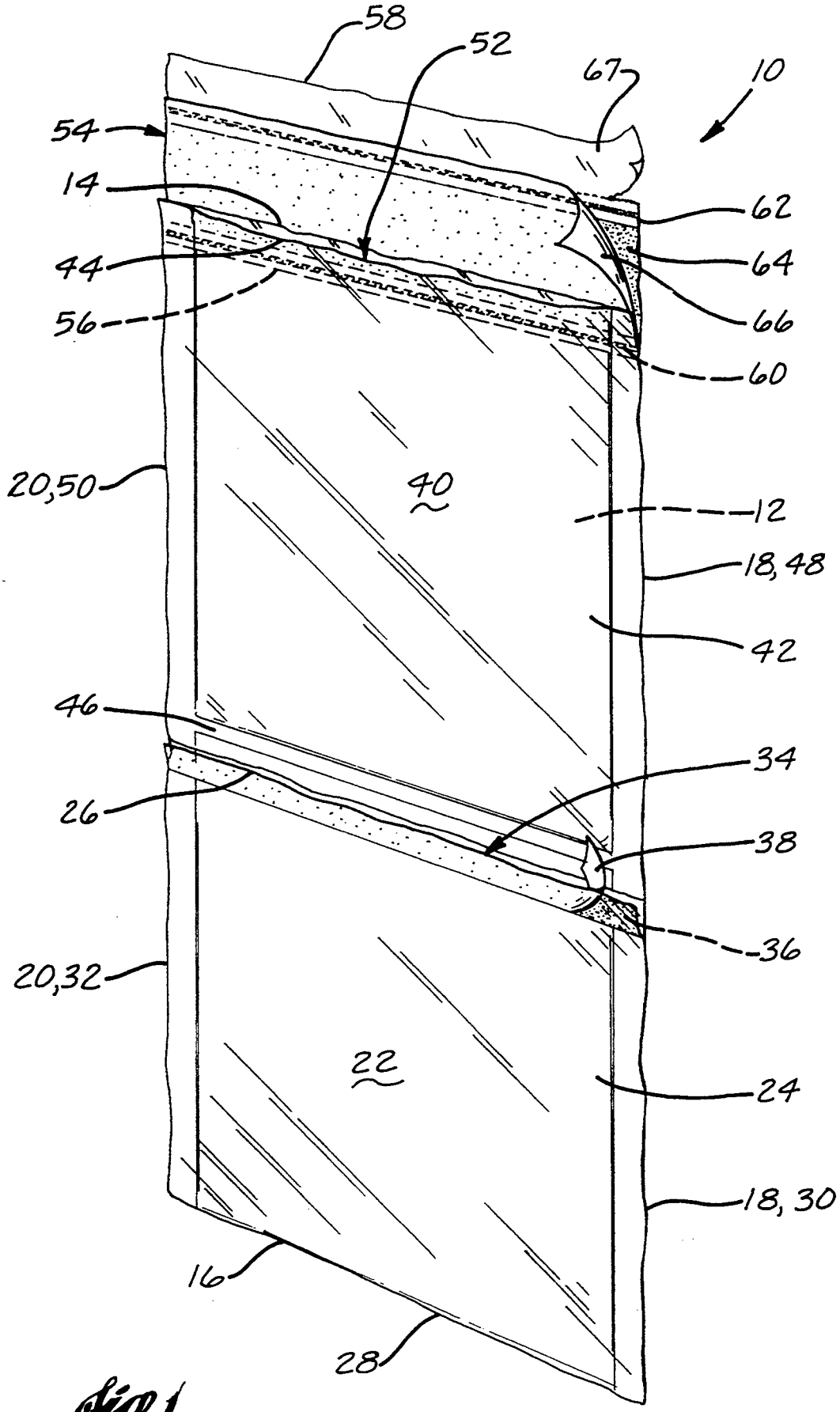
FIG. 1 is a front perspective view of a security bag formed in accordance with the present invention.
Figure 2:
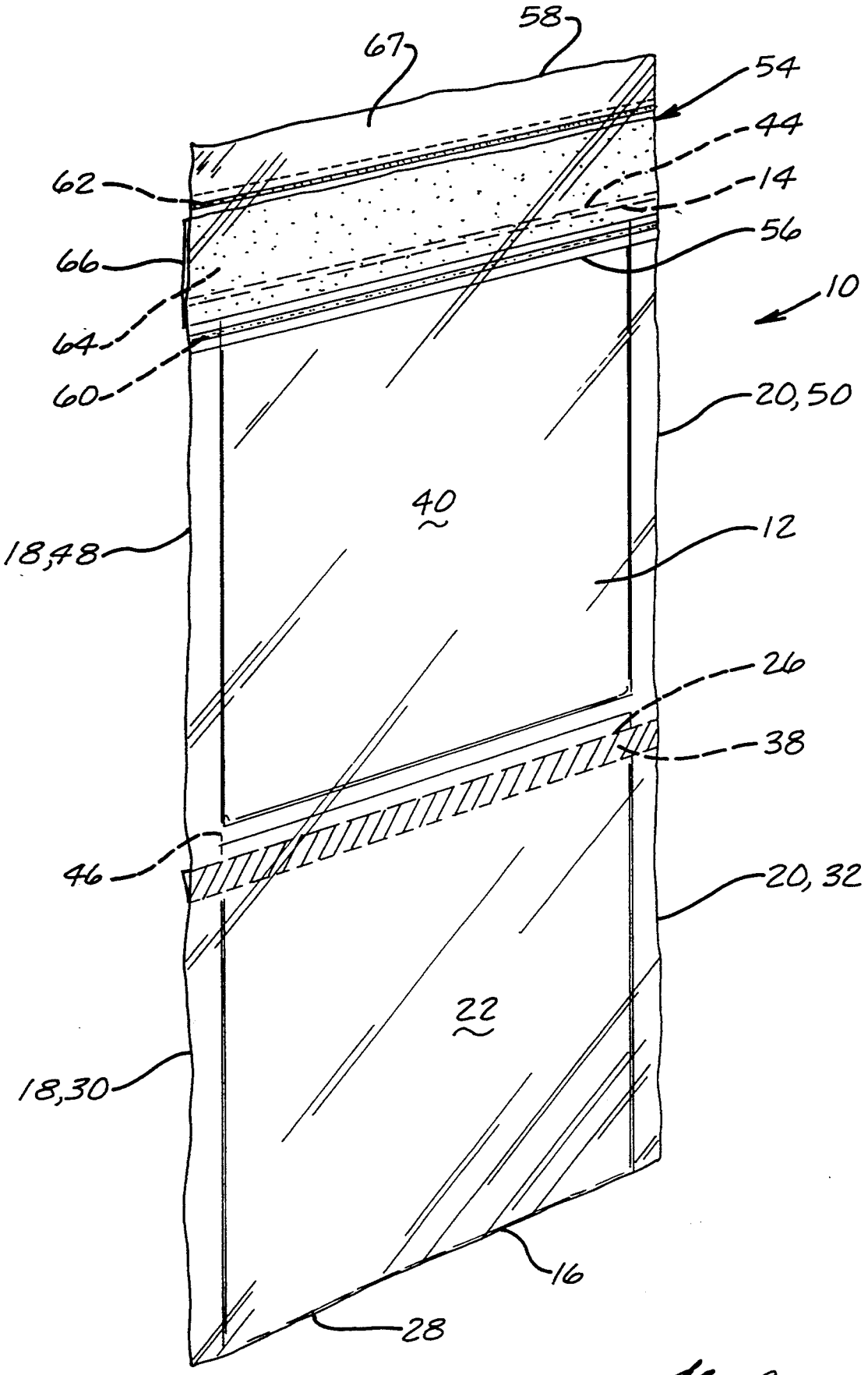
FIG. 2 is a rear perspective view of the security bag of FIG. 1.
Figure 3:
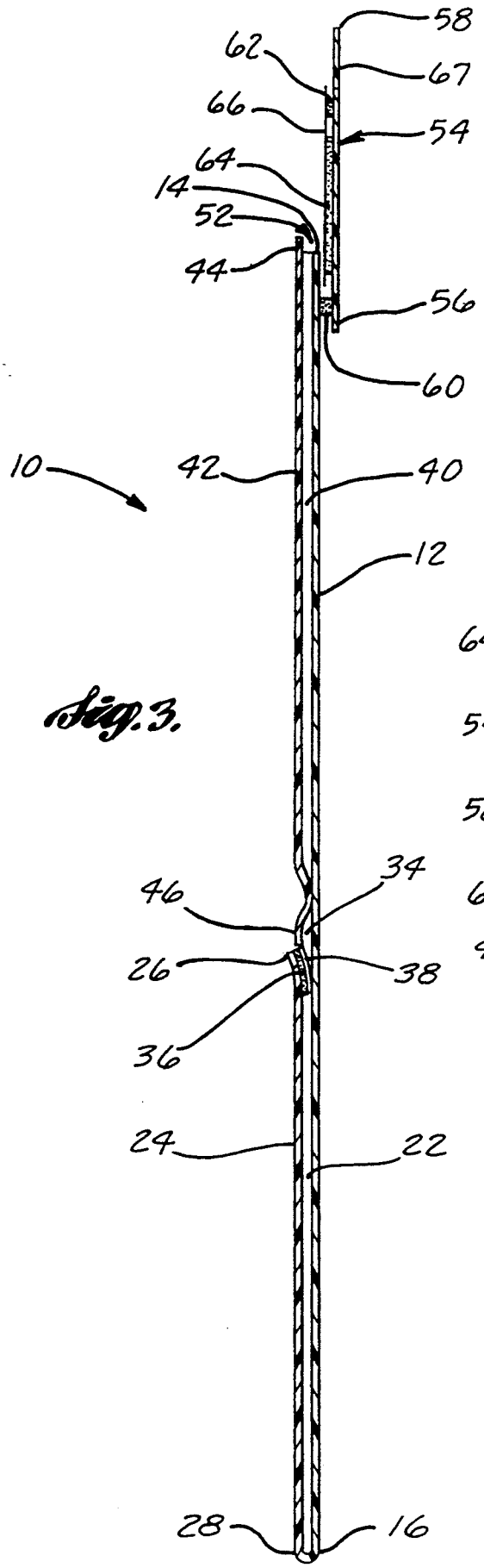
FIG. 3 is a side elevational view of the security bag of FIG. 1.

Referring to FIGS. 1, 2, and 3, security bag 10 includes a sheet of plastic that forms rear wall 12. Rear wall 12 is generally rectangular in shape and includes upper end 14 and opposing lower end 16. Opposing marginal edges 18 and 20 extend between upper end 14 and lower end 16. Security bag 10 includes lower pouch 22 formed between front wall 24 and rear wall 12. Front wall 24 is a rectangular sheet of plastic having a width substantially equal to the width of rear wall 12. In the illustrated embodiment, front wall 24 has a length that is less than one-half the length of rear wall 12. Front wall 24 includes upper end 26 and opposing lower end 28. Opposing marginal edges 30 and 32 extend between upper end 26 and lower end 28 of front wall 24. Lower pouch 22 is formed by folding a single sheet of plastic transversely to form front wall 24 connected along lower end 28 to rear wall 12 along lower end 16, and sealing marginal edges 18 and 20 of rear wall 12 to marginal edges 30 and 32 of front wall 24. In this manner, lower pouch 22 has an opening 34 adjacent upper end 26. Folding a single sheet of plastic to form front wall 24 and rear wall 12 is advantageous because of the simplicity of using a single source of plastic material and the integrity that is provided along the foldline compared to other sealing techniques, such as heat sealing. Alternatively, front wall 24 and rear wall 12 can be connected by heat sealing. Additionally, though not illustrated, front wall 24 and rear wall 12 can be formed from a single sheet of plastic by folding the sheet longitudinally to form a connection at a common marginal edge of both walls. Positioned within opening 34 is a band of adhesive 36, which in the illustrated embodiment is located on the inner surface of front wall 24. Band of adhesive 36 is covered by a release strip 38 to prevent premature adhesion to unwanted surfaces. In an alternative embodiment, adhesive band 36 could be located on the inner surface of rear wall 12 within opening 34.

Continuing to refer to FIGS. 1, 2, and 3, security bag 10 formed in accordance with the present invention includes upper pouch 40 that is formed between rear wall 12 and front wall 42. Front wall 42 of upper pouch 40 is a sheet of plastic having upper end 44 and opposing lower end 46. Opposing marginal edges 48 and 50 extend between upper end 44 and lower end 46 of front wall 42. Front wall 42 has a width that is substantially equal to the width of rear wall 12 and a length that is approximately equal to the length of rear wall 12 that is not superimposed by front wall 24. Upper pouch 40 is formed by heat sealing, or otherwise connecting lower end 46 of front wall 42 to rear wall 12 at a location spaced above opening 34, and sealing or otherwise connecting marginal edges 48 and 50 of front wall 42 to marginal edges 18 and 20 of rear wall 12. In this manner, upper pouch 40 is formed between front wall 42 and rear wall 12 with opening 52 near upper end 14 and upper end 44. Alternatively, though not illustrated, front wall 42 can be formed by folding a single sheet of plastic longitudinally to form at least one of the connected margins of front wall 42 and rear wall 12.

Security bag 10 also includes closure flap 54 that includes a strip of plastic having a width substantially equal to the width of rear wall 12. Closure flap 54 includes lower end 56 and opposing upper end 58 that are parallel to upper ends 14 and 44. Lower end 56 is secured to the outer surface of rear wall 12 below upper ends 14 and 44 by a band of adhesive or heat seal 60. Upper end 58 also includes a band of adhesive 62. Intermediate band of adhesive 60 and band of adhesive 62 is a wider strip of adhesive 64. The location of band of adhesive 60 and wide strip of adhesive 64 is such that closure flap 54 may be folded over opening 52 to sealingly close opening 52 by sealing wide strip of adhesive 64 and band of adhesive 62 to the outer surface of front wall 42. The adhesive used in bands of adhesive 60 and 62 and wide strip of adhesive 64 are preferably permanent pressure-sensitive adhesives that interact with the plastic materials so that separation of the two results in an observable distortion of one or the other, or both. The distortion allows one to determine whether the seal has been tampered with or opened by unauthorized parties. To prevent premature adhesion of closure flap 54 to other portions of security bag 10, a release strip 66 is provided over band of adhesive 62 and wide strip of adhesive 64.

Figure 4:
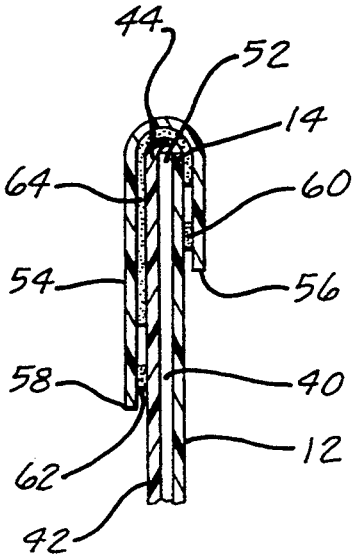
FIG. 4 is a side elevational view of a portion of the security bag of FIG. 1 with the closure flaps closed.

Referring to FIG. 4, after valuable items, such as currency, have been placed in upper pouch 40, opening 52 can be closed by removing release strip 66 from wide strip of adhesive 64 and band of adhesive band 62. Thereafter, closure flap 54 is folded over opening 52 and wide strip of adhesive 64 and band of adhesive 62 are secured to the outer surface of front wall 42.

When valuable articles, such as negotiable instruments or deposit slips, have been placed in lower pouch 22, opening 34 can be closed by removing release strip 38 from adhesive band 36 and then contacting adhesive band 36 with the inner surface of rear wall 12. The adhesive forming adhesive band 36 is preferably a releasable adhesive with respect to the plastic material. By providing a releasable adhesive on adhesive band 36, the user may repeatedly open and close the lower pouch so that additional negotiable instruments may be added or corrections may be made to the deposit slips contained therein.

In a preferred embodiment illustrated in FIGS. 1, 2, 3 and 4, closure flap 54 includes receipt strip 67 that is an extension of the strip of plastic that makes up the closure flap 54. To promote removal of receipt strip 67 from closure flap 54, a line of perforation can be provided above band of adhesive 62. Receipt strip 67 can be embossed or printed with numbers, letters, or other symbols that are also placed on the body of security bag 10.

Figure 5:
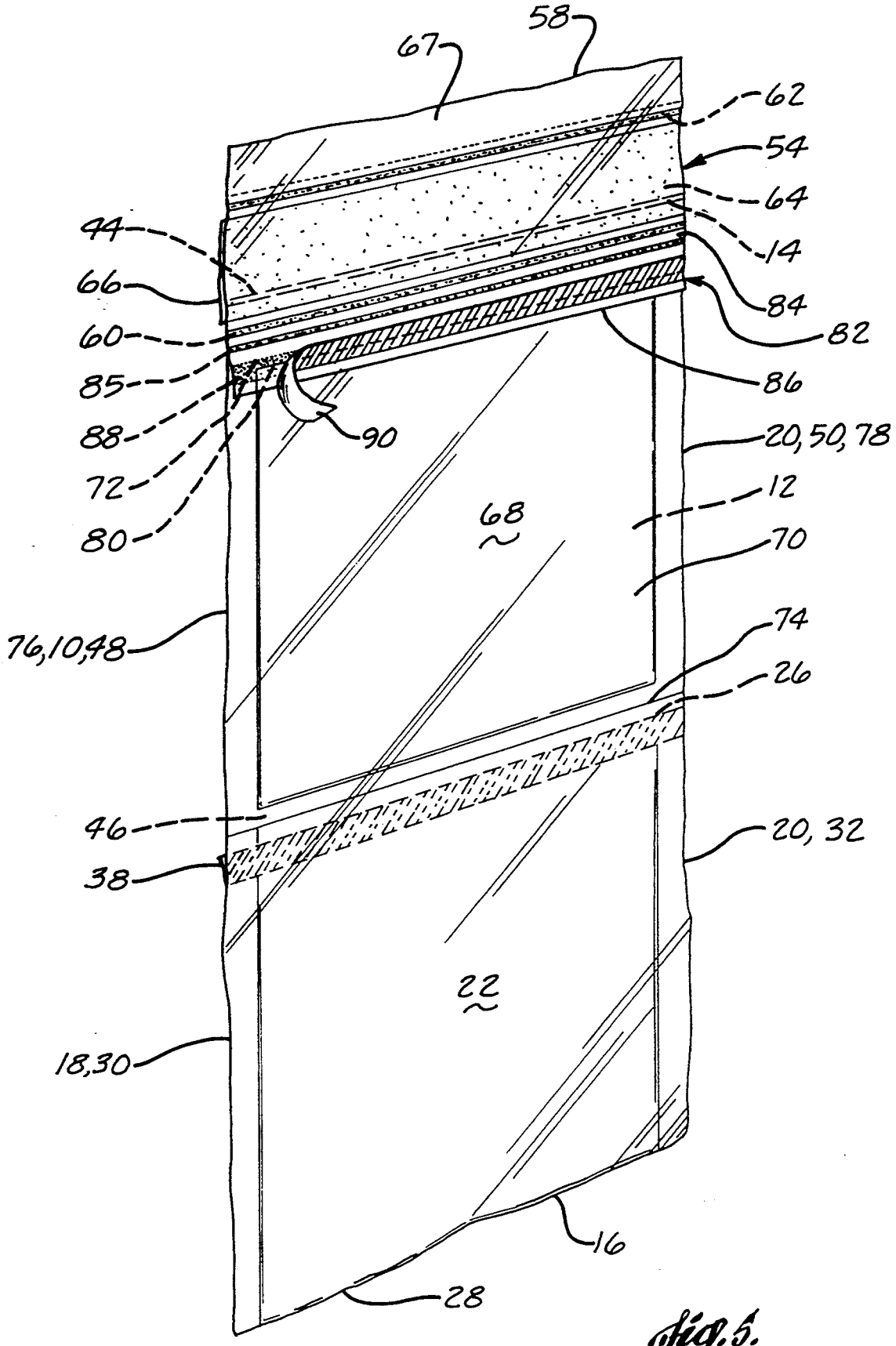
FIG. 5 is a rear perspective view of another embodiment of a security bag formed in accordance with the present invention.
Figure 6:
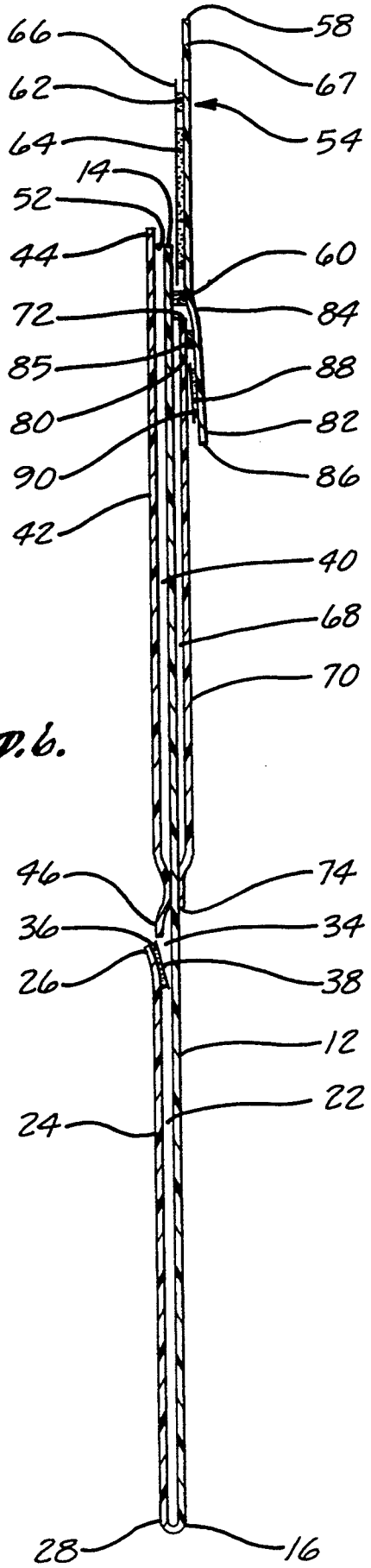
FIG. 6 is a side elevational view of the security bag of FIG. 5.

Referring to FIGS. 5 and 6, another aspect of the present invention relates to a security bag that, in addition to lower pouch 22 and upper pouch 40, described above, includes rear pouch 68 that is provided on the opposite side of rear wall 12 from upper pouch 40 and lower pouch 22. For clarity, the numbering convention used in describing FIGS. 1–4 has been adopted in FIGS. 5–7 for those elements that are common between the security bag illustrated in FIGS. 1–4 and the security bag illustrated in FIGS. 5 and 6.

In accordance with this aspect of the present invention, rear pouch 68 is formed between rear wall 12 and front wall 70 of rear pouch 68. In the illustrated embodiment, front wall 70 is a sheet of plastic having a width substantially equal to the width of rear wall 12. The length of front wall 70 can vary; however, in the illustrated embodiment, front wall 70 has a length that is slightly less than the distance between lower end 46 of front wall 42 and upper end 44 of front wall 42. Front wall 70 includes upper end 72 and opposing lower end 74. Marginal edges 76 and 78 extend between upper end 72 and lower end 74. To form rear pouch 68, lower end 74 is sealed or otherwise connected to the side of rear wall 12 opposite the side to which front walls 24 and 42 are sealed, and sealing or otherwise connecting upper end 72 to rear wall 12 below opening 52, and sealing or otherwise connecting marginal edges 76 and 78 to marginal edges 18 and 20. In the illustrated embodiment, lower end 74 is sealed to rear wall 12 along a line corresponding to the line where lower end 46 is sealed to rear wall 12. Front wall 70 below upper end 72 is perforated along a line parallel to upper end 72. Perforation 80 provides a means for gaining access to the interior of rear pouch 68. Perforation 80 also provides a means to detect whether rear pouch 68 has been entered. If perforation 80 is broken, one will know to check to see if the underlying pouch, e.g., upper pouch 40 in the illustrated embodiment, has been opened by cutting through rear wall 12.

Still referring to FIGS. 5 and 6, security bag 10 includes closure flap 82 that is a rectangular sheet of plastic having a width substantially equal to the width of rear wall 12. Closure flap 82 for rear pouch 68 includes upper end 84 and opposing lower end 86. Upper end 84 of closure flap 82 is parallel to upper end 72 and is affixed to rear wall 12 by strip of adhesive 85 at a location above perforation 80. The distance between upper end 84 and lower end 86 (i.e., the length of closure flap 82) is sufficient to allow lower end 86 to extend below perforation 80. Lower end 86 of closure flap 82 includes a band of adhesive 88 on its inner surface. Band of adhesive 88 extends across the width of closure flap 82 and is covered by release strip 90. When it is desired to close perforation 80, release strip 90 is removed from band of adhesive 88 and closure flap 82 is sealed to front wall 70. Adhesive on band of adhesive 88 is of the type described above with respect to adhesive band 36. It is generally an adhesive that will releasably seal closure flap 82 to front wall 70 of rear pouch 68.

The plastic material used to make the security bags formed in accordance with the present invention can be selected from conventional plastics, such as polyethylene. The security bags described above can be manufactured using techniques and equipment presently known to the industry.

Security bag 10 is used by depositors in the following manner. Currency is placed in upper pouch 40. Since currency is the target for most parties who are attempting to gain unauthorized entry into security bag 10, as described above, upper pouch 40 is provided with a tamper-evidencing closure member. Lower pouch 22 is intended to receive negotiable instruments and/or deposit slips. Since parties who are attempting to gain unauthorized entry into security bag 10 are less interested in the negotiable instruments or the deposit slips, a reclosable closure means is provided on lower pouch 22. In a preferred embodiment, the plastic sheets making up upper pouch 40 and lower pouch 22 include at least one that is transparent so that the user may see the contents in their respective pouches. The filled security bag is then delivered by the depositor to a transport company, which delivers the bag to a banking institution. The banking institution generally removes the checks from the lower pouch first and records the mount of the checks on a "cash in" ticket. This "cash in" ticket is then associated with the security bag or forwarded separately to the location where the currency pouch is delivered. Typically, the currency pouch is delivered to a vault at the central branch of the banking institution. At the central branch, the cash is counted and added to the amount of the deposited negotiable instruments recorded on the "cash in" ticket to reconcile the total deposit.

When the security bag includes the rear pouch described above with respect to FIGS. 5 and 6, the banking institution can use the rear pouch to carry the "cash in" ticket or other accounting information. As described above, since the rear pouch includes perforation 80, which must be broken before the "cash in" ticket or deposit slips can be placed therein, the banking institution can monitor whether or not someone has attempted to enter the underlying currency pouch through the rear pouch by checking the integrity of the perforation. If the perforation is broken, the bank may choose to refuse acceptance of the deposit bag.

While the invention has been defined in terms of a bag for use with negotiable instruments and currency, it must be understood that other articles can be placed in the bag without departing from the spirit and scope of the present invention. In the illustrated embodiments, the walls of the bag are transparent; however, opaque walls may also be used in accordance with the present invention.

The invention and its intended advantages will be understood from the foregoing description and it will be apparent that various changes may be made in the form, construction, and arrangements of the parts without departing from the spirit and scope thereof or sacrificing its material advantages, the arrangements hereinbefore described being merely by way of example.

The embodiments of the invention in which an exclusive property or privilege is claimed are defined as follows:

1. A security bag for storing and transporting valuable articles, said bag comprising:

a first sheet of plastic having a first length and a first width, opposing marginal first and second edges and opposing first and second ends extending between the marginal first and second edges;

a second sheet of plastic having a width substantially equal to said first width and a length less than said first length, the second sheet connected along a lower end to the second end and connected along marginal edges to said first and second marginal edges to provide a lower pouch open at an upper end between the first sheet and the second sheet;

a third sheet of plastic having a width substantially equal to said first width and a length approximately equal to or less than the difference between the length of the second sheet and said first length, the third sheet connected along a lower end to the first sheet above the lower pouch and connected along marginal edges to the first and second marginal edges to provide an upper pouch open at the first end between the first sheet and the second sheet;

an adhesive for sealing the opening of the lower pouch, said adhesive positioned within the opening of the lower pouch; and a closure for sealing the opening of the upper pouch.

2. The security bag of claim 1, wherein the closure comprises a closure flap affixed to the first sheet for sealing the opening of the upper pouch.

3. The security bag of claim 2, wherein the closure flap includes a pressure-sensitive adhesive that prevents separation of the closure flap and the third sheet without distortion of the closure flap.

4. The security bag of claim 2, wherein the closure flap includes a pressure-sensitive adhesive that prevents separation of the closure flap and the third sheet without distortion of the third sheet.

5. The security bag of claim 1, wherein the adhesive comprises a reclosable seal for sealing the opening of the lower pouch.

6. The security bag of claim 5, wherein the first, second, and third sheets of plastic are transparent.

7. The security bag of claim 1, wherein the adhesive is on the second sheet.

8. The security bag of claim 1, wherein the adhesive is on the first sheet.

9. The security bag of claim 1, further comprising a fourth sheet of plastic having a width substantially equal to said first width, the fourth sheet connected along a lower end to a side of the first sheet opposite the side that is connected to the second and third sheets and connected along marginal edges to said first and second marginal edges to provide a rear pouch between the first sheet and the fourth sheet.

10. The security bag of claim 9, further comprising a closure for sealing the rear pouch.

11. The security bag of claim 1, wherein said first sheet and said second sheet each include an inner surface facing the other, said adhesive band positioned to secure said inner surfaces together.

12. The security bag of claim 1, wherein the first sheet, second sheet, and third sheet of plastic comprise a single sheet of plastic folded longitudinally to form the connection at a marginal edge common to the first sheet, second sheet, and third sheet of plastic.

13. The security bag of claim 1, wherein the first sheet and second sheet of plastic comprise a single sheet of plastic folded transversely to form the connection along the second end of the first sheet.

14. A security bag for storing and transporting valuable articles, said bag comprising:

a first sheet of plastic having a first length and a first width, opposing marginal first and second edges and opposing first and second ends extending between the marginal first and second edges;

a second sheet of plastic having a width substantially equal to said first width and a length less than said first length, the second sheet connected along a lower end to the second end and connected along marginal edges to said first and second marginal edges to provide a lower pouch open at an upper end between the first sheet and the second sheet;

a third sheet of plastic having a width substantially equal to said first width and a length approximately equal to or less than the difference between the length of the second sheet and said first length, the third sheet connected along a lower end to the first sheet above the lower pouch and connected along marginal edges to the first and second marginal edges to provide an upper pouch open at the first end between the first sheet and the third sheet;

a fourth sheet of plastic having a width substantially equal to said first width, the fourth sheet connected along a lower end to a side of the first sheet opposite the side that is connected to the second and third sheets and connected along marginal edges to said first and second marginal edges to provide a rear pouch between the first sheet and the fourth sheet;

an adhesive for sealing the opening of the lower pouch, said adhesive positioned within the opening of the lower pouch;

a closure for sealing the opening of the upper pouch;

a closure for sealing the opening of the rear pouch, said closure for the rear pouch including a closure flap that includes a pressure-sensitive adhesive that prevents separation of the closure flap and the fourth sheet without distortion of the closure flap.

15. The security bag of claim 14, wherein the closure of the upper pouch includes a detachable receipt.

16. The security bag of claim 14, wherein the pressure-sensitive adhesive that prevents separation of the closure flap and the fourth sheet without distortion of the closure flap is located on the fourth sheet.

17. A security bag for storing and transporting valuable articles, said bag comprising:

a first sheet of plastic having a first length and a first width, opposing marginal first and second edges and opposing first and second ends extending between the marginal first and second edges;

a second sheet of plastic having a width substantially equal to said first width and a length less than said first length, the second sheet connected along a lower end to the second end and connected along marginal edges to said first and second marginal edges to provide a lower pouch open at an upper end between the first sheet and the second sheet;

a third sheet of plastic having a width substantially equal to said first width and a length approximately equal to or less than the difference between the length of the second sheet and said first length, the third sheet connected along a lower end to the first sheet above the lower pouch and connected along marginal edges to the first and second marginal edges to provide an upper pouch open at the first end between the first sheet and the third sheet;

a fourth sheet of plastic having a width substantially equal to said first width, the fourth sheet connected along a lower end to a side of the first sheet opposite the side that is connected to the second and third sheets and connected along marginal edges to said first and second marginal edges to provide a rear pouch between the first sheet and the fourth sheet;

an adhesive for sealing the opening of the lower pouch, said adhesive positioned within the opening of the lower pouch;

a closure for sealing the opening of the upper pouch;

a closure for sealing the opening of the rear pouch, said closure including a closure flap that includes a pressure-sensitive adhesive that prevents separation of the closure flap and the fourth sheet without distortion of the fourth sheet.

18. The security bag of claim 13, wherein the closure of the upper pouch includes a detachable receipt.

19. The security of claim 17, wherein the pressure-sensitive adhesive that prevents separation of the closure flap and the fourth sheet without distortion of the fourth sheet is positioned on the fourth sheet.

* * * * *

UNITED STATES PATENT AND TRADEMARK OFFICE

CERTIFICATE OF CORRECTION

PATENT NO. : 5,352,041

DATED : October 4, 1994

INVENTOR(S) : M.G. Fullerton et al.

It is certified that error appears in the above-indentified patent and that said Letters Patent is hereby corrected as shown below:

| COLUMN | LINE | |
|---|---|---|
| 1 | 61 | "p tint" should read --print-- |
| 3 | 13 | Delete "and" |
| 3 | 15 | "FIG. 5" should read --FIG. 5; and-- |
| 3 | 48-49 | Delete "though not illustrated," |
| 4 | 10 | Delete "though not illustrated," |

UNITED STATES PATENT AND TRADEMARK OFFICE

CERTIFICATE OF CORRECTION

PATENT NO. : 5,352,041

DATED : October 4, 1994

INVENTOR(S) : M.G. Fullerton et al.

Figure 7:
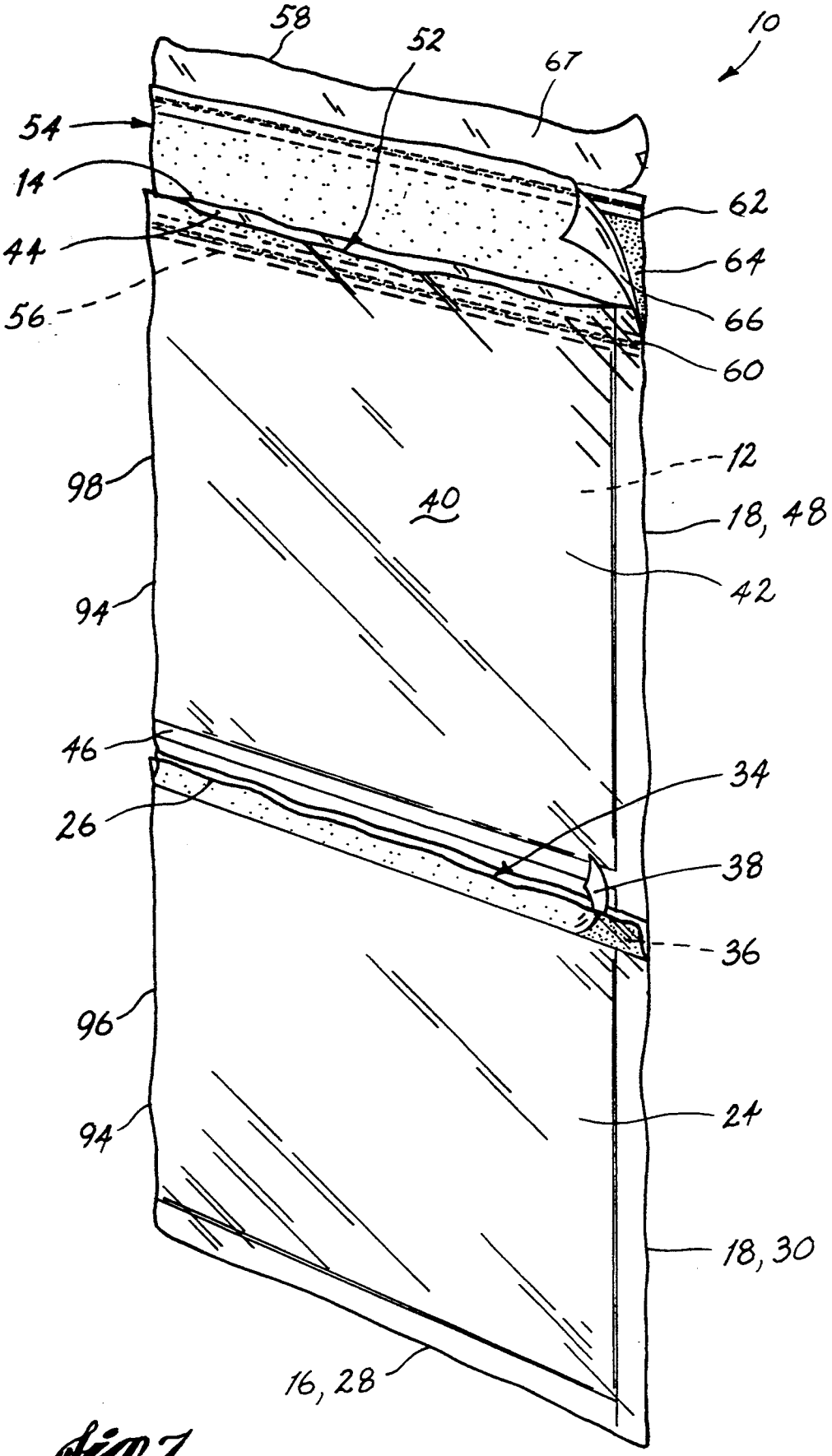
FIG. 7 is a front perspective view of another embodiment of a security bag formed in accordance with the present invention.

It is certified that error appears in the above-indentified patent and that said Letters Patent is hereby corrected as shown below:

| COLUMN | LINE | |
|---|---|---|
| 4 | 14 | Insert the paragraph: --Referring to FIGURE 7, in another embodiment of the present invention, both lower pouch 22 and upper pouch 40 can be formed by folding a single sheet of plastic longitudinally to form a connection at a common marginal edge of the respective pouches' front and back walls. More specifically, lower pouch 22 is formed by folding a single sheet of plastic longitudinally along marginal fold 96 to form front wall 24 so that front wall 24 is connected to rear wall 12 along common marginal edge 94. Marginal edge 18 of rear wall 12 is then sealed to marginal edge 30 of front wall 24, while lower end 28 of front wall 24 is sealed to lower end 16 of rear wall 12. Similarly, upper pouch 40 is formed by folding a single sheet of plastic longitudinally along marginal fold 98 to form front wall 42 so that front wall 42 is connected to rear wall 12 along common marginal edge 94. Marginal edge 18 of rear wall 12 is then sealed to marginal edge 48 of front wall 42, while lower end 46 of front wall 42 is sealed to rear wall 12 at a location spaced above opening 34. It will be obvious to those skilled in the art that upper pouch 40 and lower pouch 22 can also be formed from a single sheet of plastic by folding the sheet longitudinally to form a connection at a common marginal edge corresponding to marginal edge 18.-- |

UNITED STATES PATENT AND TRADEMARK OFFICE

CERTIFICATE OF CORRECTION

PATENT NO. : 5,352,041

DATED : October 4, 1994

INVENTOR(S) : M. G. Fullerton, et al

It is certified that error appears in the above-indentified patent and that said Letters Patent is hereby corrected as shown below:

Column 7,line 7, "second" should read --third --.

Signed and Sealed this

Twenty-first Day of February, 1995

*Attest:*

Bruce Lehman

BRUCE LEHMAN

*Attesting Officer*

*Commissioner of Patents and Trademarks*